US012746957B2

(12) United States Patent
Goforth et al.

(10) Patent No.: US 12,746,957 B2
(45) Date of Patent: Sep. 29, 2026

(54) TRAIN CONSIST BUILD OPTIMIZATION

(71) Applicant: Progress Rail Locomotive Inc., LaGrange, IL (US)

(72) Inventors: Thomas Wade Goforth, Springfield, VA (US); Rodrigo Almeida Goncalves, Campinas (BR)

(73) Assignee: Progress Rail Locomotive Inc., LaGrange, IL (US)

( * ) Notice: Subject to any disclaimer, the term of this patent is extended or adjusted under 35 U.S.C. 154(b) by 52 days.

(21) Appl. No.: 18/737,570

(22) Filed: Jun. 7, 2024

(65) Prior Publication Data

US 2025/0376198 A1 Dec. 11, 2025

(51) Int. Cl.
*B61L 27/16* (2022.01)
*B61L 27/12* (2022.01)
*B61L 27/57* (2022.01)

(52) U.S. Cl.
CPC ..... *B61L 27/16* (2022.01); *B61L 27/12* (2022.01); *B61L 27/57* (2022.01)

(58) Field of Classification Search
CPC ..... B61L 27/16; B61L 27/12; B61L 27/57
See application file for complete search history.

(56) References Cited

U.S. PATENT DOCUMENTS 4,042,810 A 8/1977 Mosher
6,377,877 B1 4/2002 Doner
6,523,413 B1 2/2003 Hoshino et al.
6,959,235 B1 * 10/2005 Abdel-Malek ..... G07C 5/008 340/988
6,961,682 B2 11/2005 Doner
7,340,328 B2 3/2008 Matheson et al.
7,813,846 B2 10/2010 Wills et al.
10,710,619 B2 7/2020 LeFebvre et al.
11,858,543 B2 * 1/2024 Akif ..... G06N 3/09
2003/0105561 A1 * 6/2003 Nickles ..... B60T 17/228 701/19

(Continued)

OTHER PUBLICATIONS

"How do train conductors/engineers determine how many locomotives to use?" published by Reddit, available on or before Dec. 31, 2017, printed from URL <https://www.reddit.com/r/trains/comments/7nbo47/how_do_train_conductorsengineers_determine_how/> (Year: 2017).*

*Primary Examiner* — Kurt Philip Liethen

(57) ABSTRACT

Combining a rail yard management system with an energy management system and health management system for optimizing a train consist build is provided. The rail yard management system determines railway cars and locomotives currently available at the rail yard. If there are not enough railway cars and/or locomotives available at the rail yard, the rail yard management system predicts or determines available railway cars and/or locomotives that are part of one or more inbound train consists. The rail yard management system queries the energy management system for energy management data associated with the locomotives to be assigned to the train consist. Planning of a desired train consist is a dynamic and iterative process where the planned train consist may be iteratively revised to include modifying the numbers and positions of locomotives to be included in the train consist for optimizing energy management and health management of the planned train consist.

20 Claims, 5 Drawing Sheets

(56) References Cited

U.S. PATENT DOCUMENTS

| | | | | |
|---|---|---|---|---|
| 2007/0005200 | A1* | 1/2007 | Wills | G06Q 50/40 701/19 |
| 2010/0019103 | A1* | 1/2010 | Kane | B61L 15/0058 60/710 |
| 2010/0032529 | A1 | 2/2010 | Kiss | |
| 2012/0089537 | A1* | 4/2012 | Cooper | B61L 15/0072 701/19 |
| 2016/0062356 | A1* | 3/2016 | Worden | G05D 1/0027 701/2 |
| 2016/0342933 | A1* | 11/2016 | Johnson | G06Q 10/083 |
| 2018/0170415 | A1* | 6/2018 | Oswald | B61L 25/023 |
| 2022/0242470 | A1* | 8/2022 | Simkin | B61L 27/16 |

* cited by examiner

TRAIN CONSIST BUILD OPTIMIZATION

TECHNICAL FIELD

The present disclosure relates generally to building and managing train consists. More particularly, the present disclosure relates to building a train consist with railway cars and locomotives that optimizes rail yard management, locomotive energy management and locomotive health management in the building of a train consist.

BACKGROUND

A train consist typically includes a number of railway cars and one or more locomotives for moving the railway cars along tracks to desired destinations. Rail yard managers are responsible for building train consists in a rail yard based on required cargo haulage, destinations and schedules. In addition to collecting railway cars at the rail yard for inclusion in a train consist, the rail yard manager must also collect one or more locomotives that will be attached to railway cars for moving the railway cars from the rail yard to a desired destination.

At any given time, the rail yard may have some but not all needed railway cars and locomotives for building the desired consist. That is, at any given time, a portion of needed railway cars and locomotives for the desired consist may be present at the rail yard, but other railway cars and/or locomotives needed for the desired consist may be inbound to the rail yard from one or more locations. In some applications, the railway cars and/or locomotives used to make up a departing train consist are continuously sourced from train consists that arrive in the rail yard. Thus, the ultimate train consist makeup of a given train consist must be predicted well before operations for coupling railway cars and locomotives can be executed. In addition, each train consist has unique power requirements due to the number of cars making up the train consist and due to terrain and other railway conditions between the rail yard and a particular destination. In a typical case one or more locomotives may be assigned to a train consist, but the number of locomotives with associated power and energy use may be inefficient for the train consist. As a result, any given train consist may be powered in a manner that moves the consist to the desired destination but lacks efficient energy management associated with locomotive assignment to the consist. In addition, locomotives available for use in a train consist may be associated with reliability information (e.g., locomotive health information) such that one locomotive may be better suited for inclusion in a train consist than another locomotive given anticipated route conditions planned for a desired train consist.

An example system for determining rail yard status using locomotive locations is described in U.S. Pat. No. 6,377,877B1 to Doner titled "Method of Determining Rail Yard Status Using Locomotive Location" (hereafter referred to as "the '877 document"). In particular, the '877 document describes a system for determining the status of a railyard. A comparator algorithm is used to compare a locomotive location to a locomotive itinerary, and railcar information is input into a manager console and communicated to a computer, which generates a locomotive task list from the railcar information. The computer then generates a locomotive itinerary, tracks the location of the locomotive, and uses the comparator algorithm to determine the schedule status of the railcar.

Although the system described in the '877 document is configured to provide locations of rail yard locomotives and rail yard cars, the '877 document does not predict inbound railway cars and inbound locomotives that may be used to combine with railway cars and locomotives currently located in a rail yard for building a train consist that optimizes locomotive energy and health information management of the resulting train consists from the rail yard to a desired destination after the built train consist departs from the rail yard. As a result, the system described in the '877 document does not provide for the assembly of a train consist from currently available railway cars and locomotives and from anticipated (i.e., predicted) railway cars and locomotives but also based on utilization of locomotives in the assembled train consist that are selected for and positioned in the train consist based on optimum locomotive energy and health utilization.

Examples of the present disclosure are directed to overcoming the deficiencies described above.

SUMMARY OF THE INVENTION

According to examples of the present disclosure, combining a rail yard management system with an energy management system and a locomotive health management system for optimizing a train consist build is provided. The rail yard management system determines railway cars and locomotives currently available at the rail yard. If there are not enough railway cars and/or locomotives available at the rail yard, the rail yard management system predicts or determines available railway cars and/or locomotives that are part of one or more inbound train consists. The rail yard management system queries the energy management system and the locomotive health management system for energy and health management data associated with the locomotives to be assigned to the train consist. Planning of a desired train consist is a dynamic and iterative process where the planned train consist may be iteratively revised to include modifying the numbers and positions of locomotives to be included in the train consist for optimizing energy management and health management of the planned train consist.

The rail yard management system queries the energy management system for an energy management profile generated for the initial train consist build where the energy management profile is based at least in part on power capacity and other energy related aspects of one or more locomotives assigned to the initial train consist build by the yard management system. If the energy management profile indicates the initial train consist build will be energy inefficient, where, for example, the one or more locomotives will overpower the initial train consist build, then the initial train consist build may be revised to make changes to the assignment of locomotives to the initial train consist to achieve a more energy efficient train consist. In addition, the railyard management system queries a locomotive health management system for locomotive health scores for individual locomotives and for a locomotive health management profile for one or more locomotives to be included in a train consist. If the locomotive health management profile for the initial train consist build is not acceptable, assignment of locomotives to the initial train consist similarly may be revised. That is, planning of a desired train consist is a dynamic and iterative process where the planned train consist may be iteratively revised to include modifying the numbers and positions of locomotives to be included in the train consist for optimizing energy and locomotive health management of the planned train consist.

In some examples, systems and techniques described herein may provide a method of building a train consist. A request is received for a train consist including one or more railway cars and one or more locomotives. A railway car and locomotive makeup is determined for the train consist. An energy management profile for the railway car and locomotive makeup is determined for the train consist. The train consist is assembled according to the railway car and locomotive makeup based at least in part on the determined energy management profile. In addition, a locomotive health management profile for the railway car and locomotive makeup is determined for the train consist. The train consist may be assembled based at least in part on the determined locomotive health management profile in addition to the determined energy management profile.

In another example, a system is provided for building a train consist. A rail yard management system is operative to receive a request for a train consist including one or more railway cars and one or more locomotives. The railyard management system is further operative to determine availability of one or more railway cars for inclusion in the train consist, to determine availability of one or more locomotives for inclusion in the train consist, and to determine a railway car and locomotive makeup of the train consist based on availability of one or more railway cars and locomotives for inclusion in the train consist. An energy management system is operative to provide an energy management profile for the railway car and locomotive makeup of the train consist to the yard management system. The rail yard management system is then further operative to assemble the train consist according to the railway car and locomotive makeup based at least in part on the provided energy management profile.

In another example, a system is provided for building a train consist. A rail yard management system is operative to determine one or more railway cars and locomotives available in a rail yard that may be used in the train consist and to predict one or more railway cars and locomotives inbound to the rail yard that will be available for use in the train consist after arrival at the rail yard. The rail yard management system is further operative to generate an initial train consist build based on one or more railway cars and locomotives available for use in the train consist. An energy management system is operative to generate an energy management profile for the initial train consist build based at least in part on inclusion of energy management information associated with one or more locomotives included in the initial train consist build. The rail yard management system is further operative to determine whether the initial train consist build is optimized for energy efficiency based at least in part on whether the energy management information associated with one or more locomotives included in the initial train consist build indicates energy associated with the one or more locomotives exceeds energy required for moving a train consist built according to the initial train consist build along a planned route for the train consist.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Wherever possible, the same reference numbers will be used throughout the drawings to refer to the same or like parts. In the figures, the left-most digit(s) of a reference number identifies the figure in which the reference number first appears.

Figure 1:
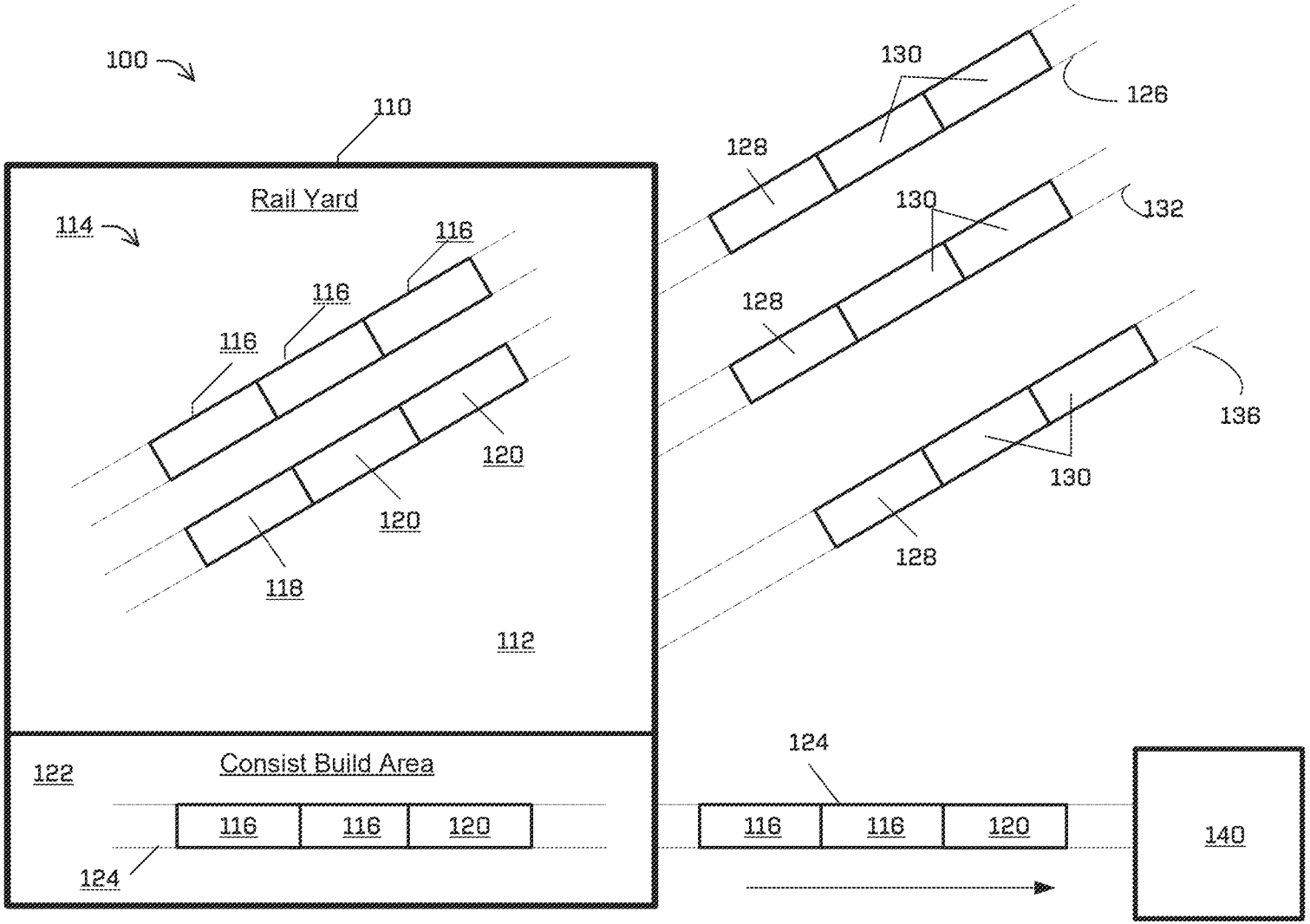
FIG. 1 illustrates an example railway system showing a rail yard with a collection of railway system components for building one or more train consists and showing inbound and outbound train consists.

FIG. 1 illustrates an example railway system 100 showing a rail yard with a collection of railway system components for building one or more train consists and showing inbound and outbound train consists. As illustrated in FIG. 1, a rail yard 110 is provided at which train consists according to examples of the present disclosure are built. For example, the rail yard 110 may be positioned at a city, town, industrial area, or other location where train consists are built and to and from which inbound and outbound train consists may be processed. That is, the rail yard 110 may be located in a location to which train-based cargo is regularly shipped and from which train-based cargo is regularly shipped. When inbound train consists arrive at the rail yard 110, railway cars may be unloaded, loaded, or may be attached to a train consist build that is destined for another location (e.g., another city).

At the rail yard 110, one or more rail yard tracks 114 are provided in a rail yard collection area 112 on which are maintained one or more railway cars 116, switcher locomotives 118 and road/mainline locomotives 120. According to examples, the railway cars 116 are awaiting unloading, loading, and/or assignment to train consists that will eventually depart from the rail yard 110. One or more rail yard switcher locomotives 118 are provided for moving railway cars 116 in the rail yard 110 for building a train consist for departure from the rail yard 110. As known by those skilled in the art, rail yard switcher locomotives are typically lower powered and/or lower geared locomotives used for moving railway cars or locomotives often one railway car or locomotive at a time into position for attachment to other railway cars and/or locomotives in the rail yard 110. Road or mainline locomotives 120 are provided and may be positioned in the rail yard 110 for inclusion in train consists that will depart from the rail yard 110 for a desired destination. As known to those skilled in the art, road or mainline locomotives 118 are higher powered or alternatively geared (i.e., higher than rail yard switcher locomotives) used for pulling or pushing train consists across open-rail systems outside rail yards from a departure rail yard 110 to a desired destination 140. According to examples, the process of assembling a train consist 124 in the consist build area 122 may be manual process or may be an automated process directed by the rail yard management system 208 (described below with reference to FIG. 2).

Referring still to FIG. 1, the rail yard 110 includes a consist build area 122 where train consists 124 are built that will depart the rail yard 110 bound for a destination 140 such as another rail yard 110 located in another city or location. According to examples, the train consist 124 is built in the consist build area 122 by causing rail yard switcher locomotives 118 to move railway cars 116 currently in the rail yard 110 into the consist build area 122 by connecting a rail yard switcher locomotive 118 to one or more railway cars 116 and by moving the railway cars 116 into position on a track in the consist build area 122. In addition to the railway cars 116, one or more road or mainline locomotives 120 (hereafter referred to simply as "locomotive" as opposed to "switcher locomotive") are moved from the rail yard collection area 112 into the consist build area 122 for connection to the train consist 124 for ultimately pulling or pushing the train consist 124 out of the rail yard consist build area 122 and toward the desired destination 140.

Referring still to FIG. 1, one or more inbound train consists 126, 132, 136 are illustrated traveling into the rail yard 110. According to examples, each of the train consists may include one or more railway cars 130 for carrying cargo of different types and one or more locomotives 128 for pulling or pushing the train consists 126, 132, 136 along tracks from one location to another. As illustrated in FIG. 1, each of the inbound train consists 126, 132, 136 may travel into the rail yard 110 where the railway cars 130 may be unloaded, reloaded with other cargo, or may be separated from other railway cars before being attached to a different train consist that will be sent to another destination. Similarly, the locomotives 128 of the inbound train consists 126, 132, 136 may be disconnected from the inbound train consists and then may be repurposed into one or more different train consists that will subsequently depart to a desired destination 140.

According to examples and as described in detail below with reference to FIGS. 2-5, the train consist 124 is built to optimize operation of the train consist 124 from the rail yard 110 to the destination 140 both in terms of rail yard system management (i.e., getting desired cargo to a desired destination according to a desired schedule) and energy management where the train consist travels at appropriate speeds across anticipated routes (including varying terrain, curves, speed changes, stops, and the like) with optimized energy usage associated with the locomotives 120, 128 used for pulling or pushing the train consist to the desired destination 140.

Figure 2:
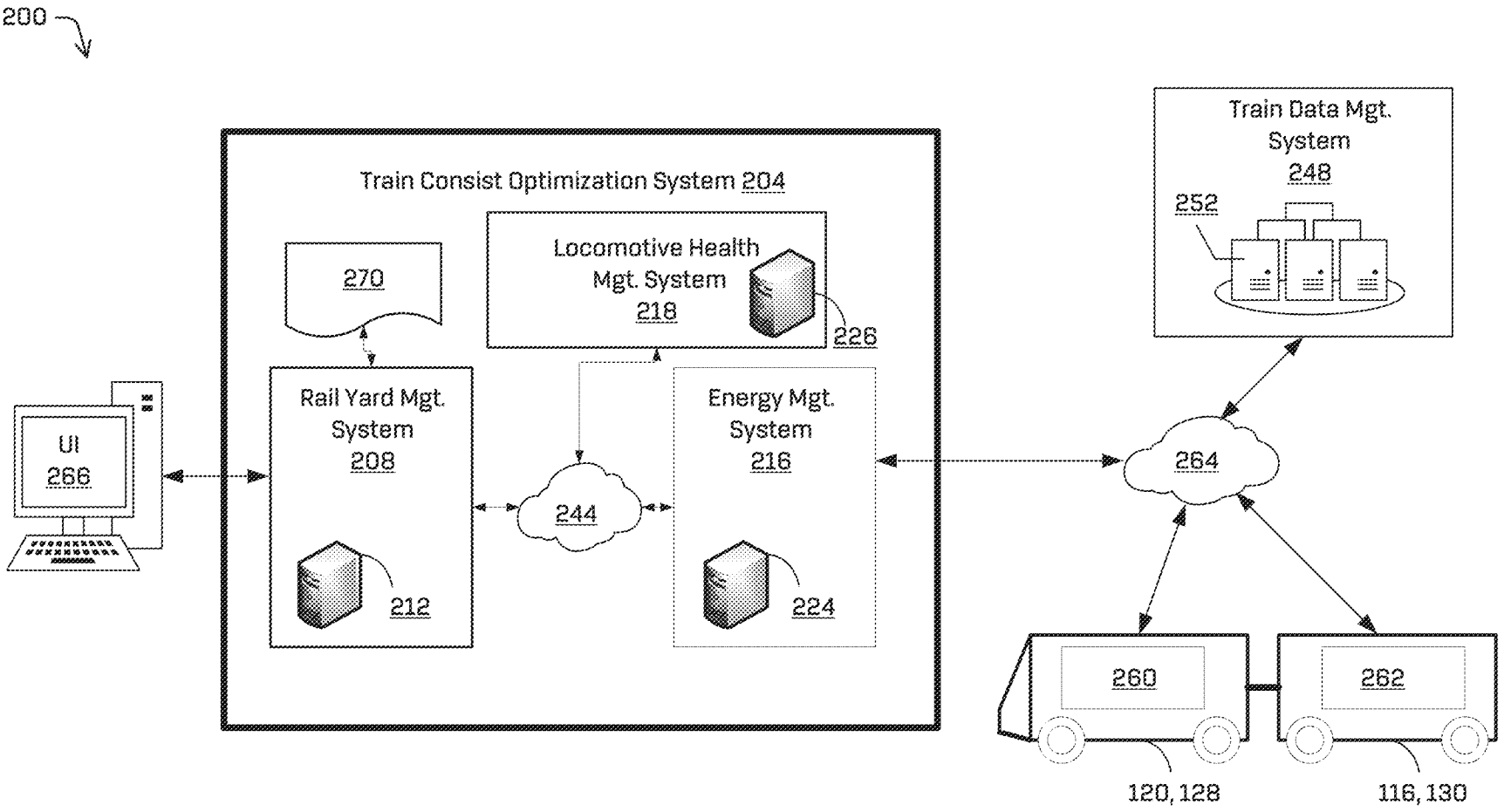
FIG. 2 illustrates a system architecture for optimizing a train consist build in association with a rail yard management system and an energy management system.

FIG. 2 illustrates a system architecture 200 for optimizing a train consist build in association with a rail yard management system and an energy management system. According to examples of the present disclosure, the system 200 includes a train consist optimization system 204 that is operative to manage operations and train consist builds at the rail yard 110. In particular, the train consist optimization system 204 includes a rail yard management system 208 that manages rail yard operations and train consist builds in concert with an energy management system 216 from which the rail yard management system 208 obtains energy management information for one or more locomotives 120, 128 that may be included in a train consist 124 to provide optimization of a built train consist for normal operations such as train cargo delivery to desired destinations according to a given schedule but also in a manner that optimizes the energy management of a built train consist. According to examples, the rail yard management system 208 also obtains information from a locomotive health management system 218 that quantifies the reliability or "health" of locomotives. The locomotive health management system uses locomotive current and historical performance data to predict maintenance issues on locomotives. A railway carrier or operator may set operating preferences for locomotive health on a route, where highly reliable locomotives are required to operate over routes that require a large amount of horsepower and proper maintenance due to train consist weight or route conditions (e.g., terrain, starts/stops, slow down zones, and the like).

Figure 5:
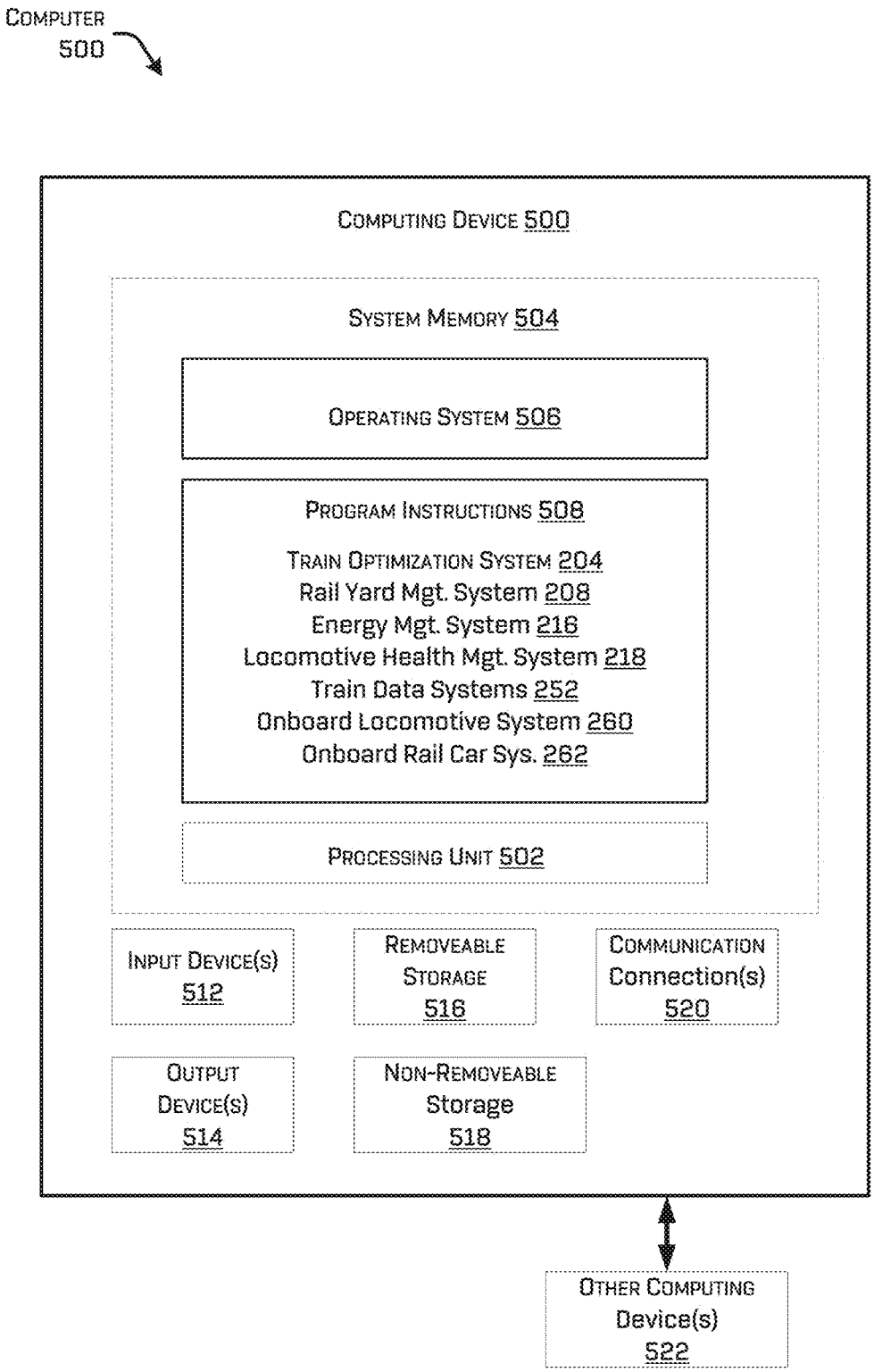
FIG. 5 is a computer architecture diagram showing an illustrative computer hardware architecture for implementing a computing system/device that can be utilized to implement aspects of the various technologies presented herein.

The rail yard management system 208, the energy management system 216, and the locomotive health management system 218 may be implemented via general and/or specific purpose computing systems 212, 224, 226, respectively, and may communicate with each other over a local or distributed (e.g., Internet) network 244. Alternatively, the rail yard management system 208, the energy management system 216, and the locomotive health management system 218 may be integrated together as components of a single computing system, as illustrated in FIG. 5. Operation of the rail yard management system 208 and the energy management system 216 is described in detail below.

Referring still to FIG. 2, the train data management system 248 is illustrative of a data repository in which information about train consists and/or individual components of a train consist such as locomotives, railway cars, as well as rail systems, such as track systems, switching systems, and the like may be stored. According to examples, the train data management system 248 may be operated for a single railway carrier at which data for its railway cars, locomotives and rail systems may be stored, or the train data management system 248 may be a central data repository where data from numerous railway carriers may be stored. As illustrated in FIG. 2, the train data management system 248 may employ one or more computing systems 252 for receiving, storing, processing, and distributing data. According to examples of the present disclosure, the train data management system 248 may operate remotely from the train consist optimization system 204 and may communicate with the train consist optimization system 204 through a local or distributed network 264. For example, as will be described in further detail below, the rail yard management system 208 may require data for a given railway car 130 or a given locomotive 128. According to examples, the rail yard management system 208 may query the train data management system 248 with an identification number, code or other identifier for a given railway car or locomotive to receive data such as scheduling and destination information or physical information such as weight, cargo being carried, and energy management data for locomotives.

The locomotive 120, 128 is illustrative of a locomotive that may be present in the rail yard 110 or that may be included in an inbound train consist 126, 132, 136 and that may be used by the rail yard management system 208 for building a train consist 124 for departing the rail yard 110 bound for a destination 140. According to examples, the locomotives 120, 128 (and switcher locomotives 118) may include combustion locomotives (e.g., diesel), electric locomotives, hybrid (fuel/electric) locomotives, gas turbine engine locomotives, and the like. The locomotive 120, 128 may include an onboard data and energy management system 260 for passing operational information such as horsepower rating, horsepower-per-ton towing capacity rating, fuel or electricity usage information, weight, performance through curves, grade variations and speed changes, as well as, onboard engine performance data such as fuel and/or electricity levels and consumption rates, battery capacity, engine temperatures, engine RPMs at varying operating conditions, fluid levels and pressures, and the like to the train data management system 248 or directly to the rail yard management system 208 and/or to the energy management system 216 via a local or distributed network 264. As should be appreciated, the onboard data and energy management system 260 of the locomotive 120, 128 may receive operational data for the locomotive via one or more sensors (e.g., weight sensors, speed sensors, engine performance sensors, etc.) integrated with the locomotive.

The railway car 116, 130 is illustrative of a railway car positioned at the rail yard 110 or included in an inbound train consist 126, 132, 136 that may be used by the rail yard management system 208 for inclusion in a train consist build 124, as described herein. Like the locomotive 120, 128, the railway car 116, 130 may include an onboard data system 262 implemented via one or more sensors for collecting, processing, and storing information on the railway car such as speed, weight, cargo being carried, and the like. Data from the railway car 116, 130 may be stored at the train data management system 248 or may be passed directly to the rail yard management system 208 and/or to the energy management system 216 to allow the rail yard management system 208 to use the railway car 116, 130 in a consist build 124, as described herein.

The user interface 266, described in further detail below, is illustrative of a user interface provided by the rail yard management system 208 for presenting information to rail yard personnel about operations at the rail yard 110 such as locations, cargo, schedules and the like for railway cars, switcher locomotives and mainline locomotives. According to examples of the present disclosure, the user interface 266 provides information to rail yard personnel about all aspects of a planned train consist build 124 being generated by the rail yard management system 208.

Referring still to FIG. 2, as briefly described above, the train consist optimization system 204 serves as the central analysis and management system for building train consists according to examples of the present disclosure. According to examples, the rail yard management system 208 is a computer-implemented system for receiving information about railway cars 116, rail yard switcher locomotives 118, and locomotives 120 currently available in the rail yard 110, as well as information about railway cars 130 and locomotives 128 contained in one or more inbound train consists 126, 132, 136, as illustrated in FIG. 1. Information about railway cars, rail yard switcher locomotives, and locomotives received and utilized by the rail yard management system 208 includes, but is not limited to, location, weight, speed of movement, positions of locomotives relative to railway cars, force constraints at coupling points between railway cars or between railway cars and locomotives, and the like.

According to one example, the rail yard management system 208 receives energy management and locomotive health management information for locomotives 120, 128 currently positioned in the rail yard 110 or contained in an inbound train consist 126, 132, 136. The rail yard management system 208 may receive energy management information from the energy management system 216 and locomotive health information from the locomotive health management system 218, described below, from the train data management system 248, or directly from the onboard data management system 260 of locomotives 120, 128. Energy management information may include performance data such as horsepower rating, horsepower-per-ton towing capacity rating, fuel or electricity usage information, weight, performance through curves, grade variations and speed changes, as well as onboard engine performance data such as fuel and/or electricity levels and consumption rates, battery capacity, engine temperatures, engine RPMs at varying operating conditions, fluid levels and pressures, and the like. As described further below, locomotive health information may include reliability information for locomotives, for example, locomotive maintenance data, fuel and electricity consumption data, and the like. The rail yard management system 208 may utilize energy management and locomotive health information for locomotives for optimizing the build of a train consist 124 where the energy management and locomotive health information may be used for determining a number and positioning of locomotives in a train consist build so that the train consist build will operate in an energy efficient and reliable manner.

Such information available to the rail yard management system 208 may be provided or derived via a number of devices or systems. For example, weight information may be received by the rail yard management system 208 via one or more weight sensors (e.g., axle weight sensors), or weight of individual railway cars or locomotives may be transmitted to the rail yard management system 208 from data stored for each railway car or locomotive at onboard computing systems 260, 262, or stored at the train data management system 248 into which one or more train carriers (e.g., rail companies) may transmit information associated with their respective railway cars and/or locomotives. According to examples, the rail yard management system 208 may query such data sources for information, or such information may be automatically transmitted to the rail yard management system 208 when a given railway car or locomotive enters the rail yard 110, or when railway cars or locomotives contained in an inbound train consists approach the rail yard 110.

Other information such as location and speed of travel for train consists and individual railway cars and/or locomotives in a train consist may be derived from on-board sensors such as global positioning system (GPS) sensors or similar systems, or from onboard systems 260, 262 that communicate with track-based sensors as railway cars or locomotives pass track-based sensors. Such information may be queried by the rail yard management system 208 or may be stored as described above and may be transmitted directly to the rail yard management system 208. Routes or scheduling information similarly may be stored on board each railway car 116, 130 and/or locomotive 120, 128, or may be stored for railway cars or locomotives at the train data management system 248.

According to examples, the ability of the rail yard management system 208 to receive such information for railway cars and locomotives currently positioned in the rail yard 110 or traveling inbound to the rail yard 110 as part of inbound train consists allows the rail yard management system 208 to determine currently available rail assets that may be used to build a train consist. That is, the rail yard management system 208 may determine railway cars and locomotives currently available in the rail yard 110 and may predict future available railway cars 130 and/or locomotives 128 contained in one or more inbound train consists that will be available to the rail yard management system 208 for building a train consist that will depart from the rail yard 110 to a desired destination 140, as described above with reference to FIG. 1.

For example, if an inbound train consist 126, 132, 136 contains a railway car 130 that is operated by a given rail carrier, the rail yard management system 208 may automatically receive information from the railway car, or the rail yard management system 208 may query the railway car or the train management data system 248 for information such as railway car location, weight, speed of travel, destination, route, etc. The rail yard management system 208 may use this information to build the inbound railway car into a train consist 124 that will depart the rail yard 110 bound for a desired destination 140. That is, based on the scheduled arrival of the example railway car 130 at the rail yard 110, the speed of the railway car 130, the weight of the railway car 130, the desired destination of the railway car 130, etc., the rail yard management system 208 can plan to place the railway car 130 in a train consist 124 bound for the destination required for the railway car 130 that will be departing from the rail yard 110 according to a desired schedule. The weight of the railway car 130 will allow the rail yard management system to 208 to assign appropriate locomotive power to the train consist to get the train consist to the desired destination over varying terrain and route conditions according to the desired schedule.

According to examples of the present disclosure, the rail yard management system 208 receives similar information for locomotives 120 currently available in the rail yard 110 and for inbound locomotives 128 associated with one or more inbound train consists 126, 132, 136, as illustrated in FIG. 1. Receiving location, speed, route, schedule, and weight information for currently available or inbound locomotives 120, 128 allows the rail yard management system 208 to predict availability of locomotives to plan use of locomotives in one or more outbound train consists 124 built by the rail yard management system 208. According to examples, as described in detail below, the rail yard management system 208 may receive energy management information for currently available or inbound locomotives to allow the rail yard management system 208 to assign one or more locomotives to an outbound train consist 124 that will optimize usage of the one or more locomotives 120, 128 based on energy management.

In addition to determining the makeup of a train consist 124, the rail yard management system 208 may determine the placement of locomotives in the train consist 124. For example, the rail yard management system 208 may determine and optimize locomotive placement based on a number of factors such as sensed coupling forces between railway cars associated with the length of the train consist, terrain, curves, and speed changes anticipated for the planned route, and the like. Based on such factors, the rail yard management system 208 may determine that locomotives should be interspersed at various locations in the train consist 124 as opposed to placing the assigned locomotives at a front end of the planned train consist 124.

As briefly described above, the energy management system 216 works in concert with the rail yard management system 208 to allow the rail yard management system 208 to build a train consist 124 at the rail yard 110 that optimizes locomotive selection and use in a train consist. According to examples, the energy management system 216 is a computer-implemented system that receives, monitors and stores energy management information for each locomotive 120, 128 that may be used by the rail yard management system 208 for assigning and positioning one or more locomotives in a train consist 124 built by the rail yard management system 208.

According to examples, energy management information for a given locomotive 120, 128 may include horsepower rating, horsepower-per-ton towing capacity rating, fuel or electricity usage information, weight, performance through curves, grade variations and speed changes, as well as, onboard engine performance data such as fuel and/or electricity levels and consumption rates, battery capacity, engine temperatures, engine RPMs at varying operating conditions, fluid levels and pressures, and the like. As described herein, energy management information for locomotives 120, 128 may be used by the rail yard management system 208 for optimizing the energy management of a train consist 124 built at the rail yard 110 for travel to a desired destination 140.

According to examples, energy management data may be used to develop energy management profiles for individual locomotives and for various previously used and potential train consists (including one or more individual locomotives) for analyzing the energy management for a given train consist. For example, the energy management profile of a given consist may be considered appropriate if the power availability for the locomotives to be included in the train consist 124 is within an energy management profile range, for example, no more than 5% excess of needed locomotive power required for moving a train consist 124 from the rail yard 110 to the desired destination 140.

For example, consider a planned train consist comprised of sixty (60) railway cars weighing a total of 200,000 pounds. If the rail yard management system 208 determines that five 2000 horsepower (hp) locomotives are available either in the railyard or predicted in one or more inbound train consists, the rail yard management system 208 may assign four 2000 hp locomotives to the planned train consist. On the other hand, if five 4000 hp locomotives are also available either in the railyard 110 or predicted in one or more inbound train consists 126, 132, 136, the rail yard management system 208 may assign two 4000 hp locomotives. However, if the planned route between the railyard 110 and the destination 140 includes hilly or mountainous terrain (varying grades), curves, stops, slow-down areas, and the like, the rail yard management system 208 in concert with the energy management system 216 and data about the available locomotives maintained either onboard each locomotive or at the train data management system 248 may determine that five 2000 hp locomotives or three 4000 hp locomotives may be needed to account for the terrain and other conditions of the planned route.

However, if simply adding additional locomotives will provide the needed additional power to account for the terrain and other route conditions but will overpower the train consist, then simply adding a locomotive of the lower-powered locomotives or the higher-powered locomotives will result in a train consist that is not energy efficient. Thus, the rail yard management system 208 may determine to use three 2000 hp locomotives and one 4000 hp locomotive or similar combination that brings the total horsepower capacity assigned to the train consist to a level sufficient to move the train consist along the planned route on schedule without overpowering the train consist and consequently making the train consist energy inefficient. According to one example, the rail yard management system 208 may query the energy management system 216 with locomotive combinations (as described above) to receive horsepower calculations for different locomotive combinations to allow the rail yard management system 208 to organize and build the train consist with appropriate power capacity and resulting energy management. In addition, by building a train consist with appropriate power capacity, excess power capacity may be used for other train consists which allows for energy efficient builds of the other train consists. As should be appreciated, other energy management factors, for example, fuel or electricity consumption rates for different locomotives may be considered in determining appropriate locomotive assignments to a train consist for operating the train consist in an energy efficient manner.

According to examples, as briefly described above, in addition to building a train consist 124 based on availability of railway cars 116, 130 and locomotives 120, 128 and based at least in part on energy management information for one or more locomotives 120, 128 potentially to be included in the train consist 124, selection of the one or more locomotives 120, 128 may also be based on locomotive health management information for one or more locomotives 120, 128. Referring still to FIG. 2, as with the energy management system 216, the locomotive health management system 218 works in concert with the railyard management system 208 to allow the railyard management system 208 to build a train consist 124 at the railyard 110 that further optimizes locomotive selection and use in a train consist. According to examples, the locomotive health management system 218 is a computer-implemented system that receives, monitors and stores locomotive health information for each locomotive 120, 128 that may be used by the railyard management system 208 for assigning and positioning one or more locomotives in a train consist 124 built by the railyard management system 208.

Locomotive health information for any of one or more locomotives 120, 128 may be stored and processed at the locomotive health management system 218, or locomotive health information for a given one or more locomotives may be stored and processed at the train data management system 248 or at onboard data management systems 260 operated on board the locomotives 120, 128. Locomotive health information for individual locomotives 120, 128 may be used for determining a locomotive health management profile for a given train consist planned by the railyard management system 208 in addition to an energy management profile determine for the planned train consist 124. According to examples, locomotive health information for a given locomotive may include reliability information such as locomotive age, locomotive maintenance information, locomotive failure information (e.g., breakdowns, required repairs, conditions under which breakdowns occurred, etc.), and fuel consumption and/or electrical usage consumption according to various route conditions (e.g., terrain, start/stop locations, slow down zones, curves, etc.). Based on such locomotive health information, a locomotive health score may be assigned to each locomotive and may be used for generating a locomotive health management profile for one or more locomotives to be included in a planned train consist 124. That is, according to examples, a health management profile may be assigned to a planned makeup of a given train consist 124.

According to examples, a locomotive health score assigned to each locomotive may be based on a number of mechanical factors for a given locomotive, but also may consider route conditions under which a given locomotive may operate. For example, a new locomotive having no maintenance issues (e.g., no past breakdowns or unresolved maintenance issues) may receive a high locomotive health score (e.g., a score of 100 on a scale of zero to 100) whereas an older locomotive with a history of maintenance issues (e.g., breakdowns and unresolved maintenance issues) may receive a lower score (e.g., a score of 30 on a scale of zero to 100). That is, locomotive health scores may be based on current and historical information for each locomotive. For a particular example, consider a locomotive that has been in service for five years and has been properly maintained and has had no reported breakdowns or other major maintenance issues. Such locomotive may receive an example locomotive health score of 90 on a scale of zero to 100. Alternatively, a locomotive that is been in service for 20 years and has had a number of reported breakdowns as well as presently reported unresolved maintenance issues (e.g., scheduled, but unrepaired bearing replacements, scheduled, but unrepaired battery updates, and the like) may receive an example locomotive health score of 30 on a scale of zero to 100.

According to examples, the locomotive health management system 218 may use locomotive health scores for each locomotive to generate a locomotive health management profile for one or more locomotives 120, 128 that may be included in a given train consist 124. For example, if three locomotives are planned by the railyard management system 208 for inclusion in a train consist 124, and the three locomotives have associated locomotive health scores of 90, 45, and 60, respectively, the locomotive health management system 218 may generate a locomotive health management profile for the planned train consist based on the locomotive health scores for the individual locomotives to be added to the planned train consist. According to one example, the locomotive health management profile may include a numerical score as used for the individual locomotive health scores assigned to each individual locomotive. For example, a simple arithmetic average of the individual locomotive health scores may be assigned to the planned train consist as a locomotive health management profile for. Alternatively, a weighted average of the individual locomotive health scores weighted according to the scores for each locomotive, weighted based on planned locomotive location in the train consist, weighted based on age of the locomotive, weighted based on a number of mechanical factors such as locomotive fuel or electricity consumption rates, or the like may be computed and assigned as a locomotive health management profile for the planned train consist. As should be appreciated the above discussion of scoring or profile numbers is for purposes of illustration and is not limiting of many other ways locomotive health scores or locomotive health management profiles may be computed and presented.

The railyard management system 208 may utilize the locomotive health management profile for the one or more locomotives planned for the train consist 124 for building the train consist. According to examples, a given rail carrier or railroad operator may have acceptable operating parameters, for example, minimum locomotive health scores or minimum locomotive health management profile requirements or rules that must be followed for train consists carrying their cargo. Alternatively, the railyard management system may likewise have minimum locomotive health scores or locomotive health management profiles for locomotives used in train consists. In some situations, rail carrier or railyard management system rules or requirements for locomotive health scores or locomotive health management profiles may be based on route conditions. For example, if a given route includes hilly or mountainous terrain, a rail carrier may require that no locomotive may be used with a locomotive health score below 75 on a scale of zero to 100 or no combination of locomotives may be used with a locomotive health management profile below 80 on a scale of zero to 100. Similarly, other considerations such as the number of stops and restarts that a planned train consist will encounter along a planned route may require locomotive health scores or locomotive health management profiles at or above certain levels given stresses encountered by locomotives for stopping and restarting the movement of train consists.

According to examples, just as assignment of locomotives to a given train consist based on energy management information may be revised iteratively until an acceptable energy management profile is achieved, assignment of locomotives based on locomotive health scores and associated locomotive health management profiles may be revised. For example, if one or more locomotives in a planned train consist is/are replaced to improve the energy management profile for a train consist, the locomotives assigned to the train consist may require revision if the replaced one or more locomotives causes the resulting locomotive health management profile to drop below a required level.

According to examples of the present disclosure, the rail yard management system 208 may be programmed to receive the inputs described above including available and predicted inbound railway cars and locomotives and aforementioned energy management and locomotive health information on available and predicted railway cars and locomotives for programmatically assigning railway cars and locomotives to a train consist as further described below with reference to FIG. 3. According to other examples, the rail yard management system 208 may also employ artificial intelligence and/or machine learning techniques to assist in both inbound railway car and/or locomotive prediction and train consist building for optimized energy and locomotive health management. According to this example, vast amounts of physical data, energy management data and locomotive health data associated with railway cars, locomotives of different types previously built train consists operating in a wide spectrum of routes and rail conditions may be fed into an artificial intelligence optimization model that allows the rail yard management system 208 to query the model for assistance in determining an optimized train consist build.

For example, energy management data profiles and locomotive health management profiles associated with a great number of train consist builds, consist weights travel speeds, speed changes, routes, terrain and the like may be fed into an artificial intelligence (AI) optimization model operated at the rail yard management system computing system 212. Thus, after the rail yard management system 208 predicts available railway cars and locomotives that may be used to build a train consist 124, the rail yard management system 208 may query the AI optimization model with conditions that will be associated with the planned train consist 124. For example, the rail yard management system 208 may initiate a query to the AI optimization model that provides the number of available railway cars, the number of available locomotives, energy management data for the available locomotives, locomotive health data for the available locomotives, route conditions (e.g., route length, terrain, curves, grades, speed changes, stops, etc.), and the like.

Based on a query directed to the vast amount of train consist (railway cars and locomotives) data fed into the AI optimization model, the trained model may return a preferred train consist that may be built by the rail yard management system 208. Alternatively, the rail yard management system 208 may be used to plan a train consist build, and the AI optimization model may be used to determine whether the planned train consist build is optimized in terms of energy management and locomotive health by querying the AI optimization model with data representing the planned train consist build to allow the AI model to compare the planned train consist with train consist data previously fed into the AI model for determining whether the planned train consist is optimized in comparison with previously optimized train consist data used to train the AI optimization model. For example, following on the above example of a train consist of sixty rail cars, the AI optimization model may return a locomotive set of two 2000 hp locomotives and two 4000 hp locomotives having a locomotive health management profile of 85. As should be appreciated, the preceding examples are for purposes of illustration only and are not limiting of a vast number of train consist combinations that may be build according to examples of the present disclosure.

Referring still to FIG. 2, information generated by the rail yard management system 208 for a planned train consist 124 may be stored as a railway car and locomotive makeup 270. According to examples, the railway car and locomotive makeup 270 may include information including the numbers and locations of one or more railway cars 116, 130 and locomotives 120, 128 that will be assembled into the train consist 124. The railway car and locomotive makeup 270 may be a data file containing information the rail yard management system 208 will use for directing assembly of the train consist 124. According to one example the railway car and locomotive makeup 270, along with associated information, may be presented to rail yard personnel via the user interface 266. For example, desired consist data such as a desired destination, desired number of railway cars and desired number of rail locomotives may be displayed. Rail yard availability and location information for available railway cars 116, 130, switcher locomotives 118 and locomotives 120, 128 may be displayed. Determined consists 1-*n* may be displayed. Energy management optimization analysis information and locomotive health management information for a selected train consist may be displayed. As should be appreciated, such information is for purposes of example only and is not limiting of a vast amount of information that may be displayed by the rail yard management system 208 for train consist component and build information.

Figure 3:
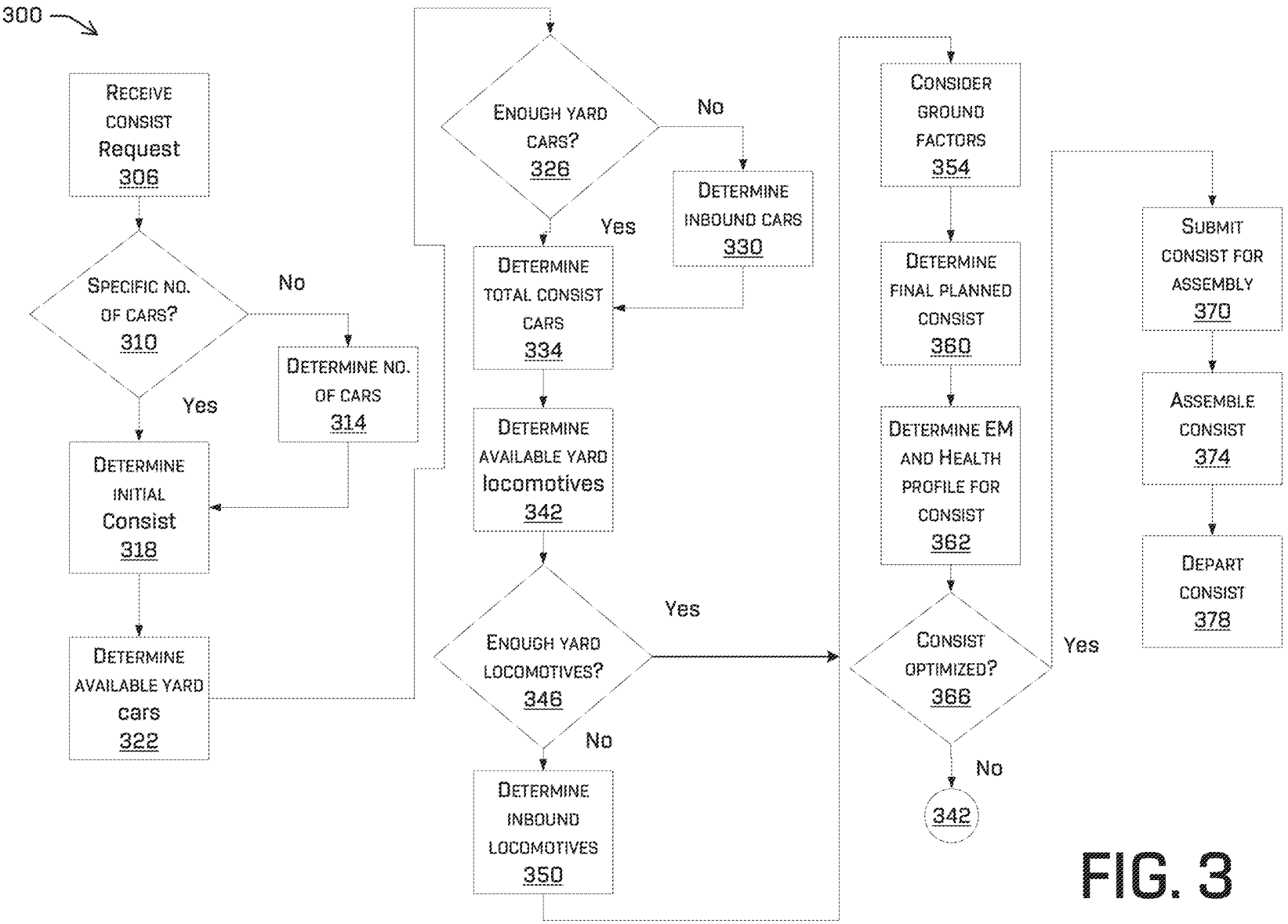
FIG. 3 illustrates a flow diagram of an example method for optimizing a train consist build in association with a rail yard management system, an energy management system, and a locomotive health management system.

FIG. 3 illustrates a flow diagram of an example method for optimizing a train consist build in association with a rail yard management system, an energy management system and a locomotive health management system. The method 300 begins at operation 306 where a request is received at the rail yard management application 208 to build a train consist bound for a destination 140. According to examples, the request received at the rail yard management application 208 to build a train consist 124 may be initiated by rail yard personnel or personnel from a rail carrier operating remotely from the rail yard 110. The requested train consist 124 may be for moving cargo of various types from the rail yard 110 to a destination 140, for example, another city nearby or a significant distance from the rail yard 110.

At operation 310, a determination is made as to whether a specific number of railway cars 116, 130 are needed for the desired train consist. For example, a specific number of railway cars may be requested by rail yard personnel or rail carrier personnel through the rail yard management system 208 because a specific need exists for a specific number of railway cars, for example, fifty (50) cars containing cargo to be transferred from the rail yard 110 to the destination 140. If a specific number of railway cars is not required, the method 300 proceeds along the "NO" branch to operation 314, and the rail yard management system 208 determines that the requested train consist 124 may be built using a varying number of railway cars that may be available in the rail yard 110 and/or that may be available from one or more inbound train consists 126, 132, 136.

If a specific number of railway cars is required at operation 310, or if an unspecified number of railway cars may be utilized for the requested train consist 124, the method 300 proceeds to operation 318, and the rail yard management system 208 determines an initial train consist makeup for the specific or unspecified number railway cars needed for the requested train consist. That is, the rail yard management system 208 determines that for a specific number of railway cars, for example, fifty cars, a specific need for locomotives, for example, three locomotives will be needed. If an unspecified number of railway cars, the rail yard management system 208 may determine an optimized number of railway cars and locomotives that have been used in similar train consists (i.e., similar loads and routes) that may be used (e.g., sixty-five railway cars and four locomotives). As described above, the rail yard management system 208 may base the determination of an appropriate number of locomotives based on power capacity and other energy management data for available locomotives by querying the energy management system 216 and based on locomotive health scores associated with available locomotives by querying the locomotive health management system 218.

Alternatively, the rail yard management system 208 may also utilize the artificial intelligence optimization model which has been trained with different train consist examples that have been built for optimized energy management and locomotive health management for requesting an optimized train consist makeup for a specified or unspecified number of railway cars, and the AI optimization model may return one or more potential train consist builds.

According to examples, the rail yard management system 208 queries the energy management system 216 for energy management information associated with locomotives 120, 128 that are requested for inclusion in the initial planned train consist build or a revised planned train consist build, as described below. As discussed above with reference to FIG. 2, in response to the rail yard management system's query to the energy management system, energy management information for one or more locomotives that are determined to be used in the initial planned or a revised planned train consist 124 is provided to the rail yard management system 208. As described above with reference to FIG. 2, if the energy management information for the one or more locomotives determined to be used in the initial planned or a revised planned train consist results in a determination that more locomotives may be needed for providing additional power for the train consist 124, the rail yard management system 208 may revise its determination to add additional locomotives. On the other hand, if the energy management information for the locomotives determined for use with the initial or revised planned train consist 124 will provide excessive amounts of power that is not needed for the train consist in terms of the weight, terrain (varying grades), curves, speed changes anticipated for the planned route to the destination 140, then the rail yard management system 208 may reduce the number of locomotives that will be used with the initial or revised planned train consist 124. Similarly, the railyard management system 208 queries the locomotive health management system 218 for locomotive health management information (i.e., locomotive health scores) associated with locomotives 120, 128 that are requested for inclusion in the initial planned train consist build or a revised planned train consist build.

According to an alternative example, one or more available locomotives 120, 128 may have different horsepower ratings such that the rail yard management system 208 may replace one or more currently determined locomotives for inclusion in the initial or revised planned train consist with one or more other locomotives where the energy management information for the one or more replacement locomotives will provide the necessary power for the initial or revised train consist in a more energy efficient manner. Similarly, one or more available locomotives 120, 128 may have different locomotive health scores such that the rail yard management system 208 may replace one or more currently determined locomotives for inclusion in the initial or revised planned train consist with one or more other locomotives where the locomotive health scores for the one or more replacement locomotives will provide the necessary locomotive health management profile for the initial or revised train consist for better locomotive reliability.

The method 300 then proceeds to operation 322, and the rail yard management system 208 determines the number of available railway cars 116 that are currently positioned in the rail yard 110. At operation 326, the rail yard management system 208 determines whether the number of available railway cars 116 currently positioned in the rail yard 110 is enough for building the requested train consist 124. If enough railway cars for the requested train consist are currently positioned in the rail yard 110, the method 300 proceeds along the "YES" branch to operation 334. If not, the method proceeds along the "NO" branch to operation 330, and the rail yard management system 208 queries one or more inbound train consists 126, 132, 136 to determine a number of railway cars 130 that are available in the inbound train consists that may be used for building the requested train consist after the inbound train consists 126, 132, 136 arrive at the rail yard 110. At operation 334, the rail yard management system 208 determines a total number of railway cars that will be included in the requested train consist 124.

At operation 342, the rail yard management system 208 determines a number of locomotives 120 that are currently positioned in the rail yard 110 and that are available for use with the requested train consist 124. At operation 346, the rail yard management system 208 determines whether the number of locomotives currently positioned in the rail yard 110 is enough for assigning to the requested train consist 124 based on the number of locomotives determined for the requested train consist at operation 318. If not, the method 300 proceeds along the "NO" branch to operation 350, and the rail yard management system 208 queries one or more inbound train consists 126, 132, 136 to determine (i.e., predict) a number of locomotives 128 that will be available for use in building the requested train consist 124 after the one or more inbound train consists arrive at the rail yard 110.

As described above, the rail yard management system 208 may determine the number of railway cars and locomotives available in the one or more inbound train consists by querying the inbound train consists directly, or by querying the train data management system 248 for information showing the number of inbound rail locomotives that may be available for use in building the requested train consist 124. Alternatively, instead of querying the railway cars and locomotives directly or querying the train data management system 248, the railway cars 130 and locomotives 128 contained in inbound train consists may be configured to automatically transmit route, location, and speed information to the rail yard management system 208 as the inbound train consists approach the rail yard 110. In either case, the rail yard management system 208 may predict available railway cars and locomotives that will be available from one or more inbound train consists 126, 132, 136. As should be appreciated, some of the railway cars or locomotives included in the one or more inbound train consists may be committed to one or more other train consists and may be unavailable for use in building the requested train consist 124. Thus, as part of the process of determining available railway cars and/or locomotives either currently available in the rail yard 110 or included in one or more inbound train consists, the rail yard management system 208 also determines whether available railway cars or locomotives may be used in the requested train consist 124.

At operation 354, the rail yard management system 208 determines whether any ground factors are present that may affect the building of the requested train consist with the determined number of railway cars 116, 130 and the determined number of locomotives 120, 128. A number of ground factors may be present that may affect the rail yard management system 208 from building the requested train consist 124. For example, if a shortage of rail yard switcher locomotives 118 will prevent the movement of the required of the determined number of railway cars and the determined number of locomotives into the train consist build area 122, or if a shortage of personnel similarly will prevent the building of the requested train consist 124, such factors may require rail yard personnel to override the determinations made by the rail yard management system 208 so that a train consist 124 may be planned with a different number of railway cars and locomotives to allow an revised version of the requested train consist to depart from the rail yard 110 on schedule.

If rail yard personnel override the rail yard management system 208, the method 300 may proceed back to operation 318, and a revised planned train consist build may be determined with a build constraint. For example, a maximum number of railway cars or locomotives or an alternate build schedule may be provided to the rail yard management system 208. Alternatively, as described above for the initial planned train consist build, the artificial intelligence optimization model may be queried with build constraint information for obtaining a revised planned train consist for the requested train consist build.

At operation 360, the rail yard management system 208 determines a final planned train consist 124 makeup of railway cars and locomotives as determined with reference to energy management and locomotive health information provided through the energy management system 216 and the locomotive health management system 218, as described herein. That is, at operation 360, the rail yard management system 208 determines a final planned train consist build based on information associated with the railway cars and locomotives to be used in the final planned train consist 124 and based on energy management and locomotive health information for the locomotives to be used in the final planned train consist, as well as ground factors information that may affect the train consist build. Alternatively, at operation 360, the rail yard management system 208 may once again query an artificial intelligence optimization model with all determined information (i.e., railway cars and locomotives to be used, energy management and locomotive health information, and ground factor information). In response, the artificial intelligence optimization model may return a train consists plan for the rail yard management system 208 that provides a makeup for the final planned train consist 124 that meets the requirements for moving the final planned train consist 124 from the rail yard 110 to the desired destination 140 and energy efficient manner based on energy management information passed to the artificial intelligence optimization model with the query from the rail yard management system 208.

In addition, the rail yard management system may then determine how the railway cars and/or locomotives should be organized. For example, if a determination is made that excessive coupling forces may be present (e.g., particularly for longer train consists or varying route terrain), the rail yard management system may determine that one or more locomotives should be interspersed among the railway cars to offset coupling forces.

At operation 362, the rail yard management system 208 may optionally analyze the final planned train consist 124 to determine whether the final planned train consist meets a preferred energy and locomotive health management profile. That is, as described above with reference to FIG. 2 an energy management profile for a built train consist may be considered appropriate if the power availability for the locomotives to be included in the final planned train consist 124 is within an energy management profile range, for example, no more than 5% excess of needed locomotive power required for moving the determined train consist 124 from the rail yard 110 to the desired destination 140.

At operation 366, the rail yard management system 208 determines whether the revised train consist build is optimized based on the determination made at operation 362. If not, the method 300 proceeds along the "NO" branch back to operation 342, and the rail yard management system 208 makes a subsequent determination of the availability of one or more locomotives that may be assigned to the requested train consists 124 to revise the current planned train consist build again to align the final planned train consist with the energy management profile for the planned train consist build. For example, since the determination of the build for the train consist 124 at operation 360, additional locomotives 128 may have become available in an inbound train consist 126, 132, 136 that have corresponding energy management information that will allow the presently determined train consist build to be revised to bring the presently determined train consist build into an acceptable energy management profile at operation 362. For example, if the presently determined train consist build will result in 10% excess power capacity, one or more lower powered locomotives may be substituted for one or more presently determined locomotives to reduce the overall power capacity into an acceptable range (e.g., no more than 5% excess power) to generate a final revised train consist makeup that will operate in an energy efficient manner. According to an example, the energy management profile check for the initial or revised train consist build may be performed at operation 318 when the initial or revised train consist is determined.

As described above, if one or more locomotives of the planned train consist is/are replaced with one or more other locomotives to improve energy management, then the locomotive health management profile for the train consist may be determined for the revised train consist to ensure the revised train consist still meets locomotive health management requirements. If additional revisions are required to optimize the train consist for locomotive health management requirements, the train consist build may be iteratively revised until both energy management and locomotive health management are optimized.

At operation 370, after all revisions are made to the initial or revised train consist build, the rail yard management system 208 finalizes assignment of railway cars 116, 130 and locomotives 120, 128 to the final train consist build. At operation 374, the rail yard management system 208 directs one or more automated systems or rail yard personnel to move railway cars and/or locomotives determined for inclusion in the final planned train consist 124 into the train consist build area 122 where the final train consist 124 is assembled by attaching railway cars and locomotives according to the determined or revised train consist makeup, and at operation 378, the assembled train consist 124 may depart the rail yard 110 for the desired destination 140, as illustrated above in FIG. 1.

Figure 4:
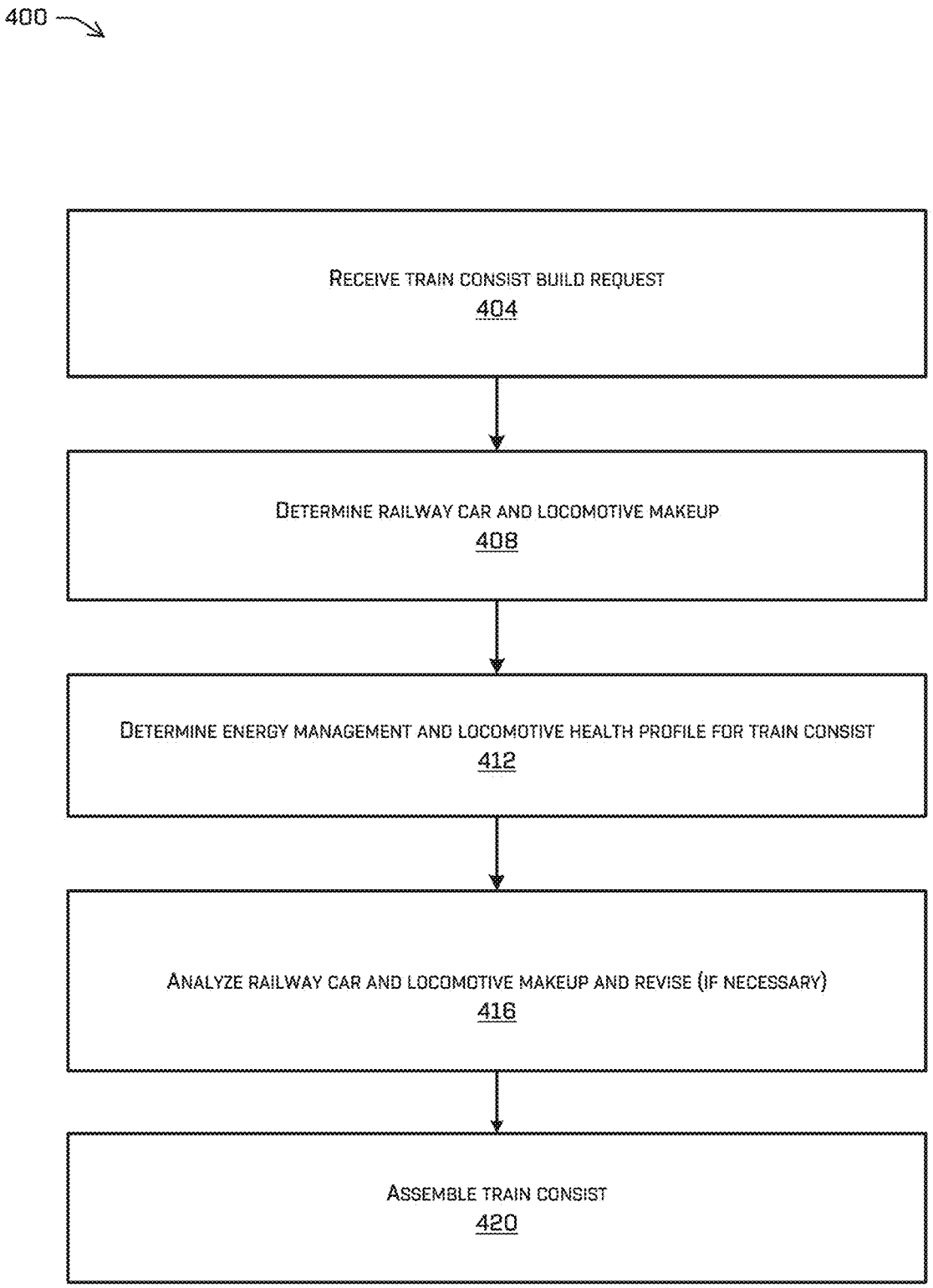
FIG. 4 illustrates a flow diagram of another example method for optimizing a train consist build in association with a rail yard management system and an energy management system.

FIG. 4 illustrates a flow diagram of another example method 400 for optimizing a train consist build in association with a rail yard management system 208, an energy management system 216 and a locomotive health management system 218. The method 400 begins at operation 404 where a request is received at a rail yard management system 208 for a train consist including one or more railway cars 116, 130 and one more locomotives 120, 128.

At operation 408, the railyard management system determines a railway car and locomotive makeup 270 for the train consist 124. According to examples, determining a railway car and locomotive makeup for the train consist 124 includes determining whether one or more railway cars are available at the rail yard 110 for inclusion in the railway car and locomotive makeup. If one or more railway cars are not available at the rail yard, the rail yard management system determines whether one or more railway cars are available in one or more inbound train consists 126, 132, 136 destined for the rail yard. In addition, prior to determining a railway car and locomotive makeup of the train consist 124, the rail yard management system 208 determines whether one or more locomotives 120, 128 are available at the rail yard 110 for inclusion in the railway car and locomotive makeup. If one or more locomotives are not available at the rail yard 110, the rail yard management system 208 determines whether one or more locomotives are available in one or more inbound train consists destined for the rail yard.

According to examples, determining whether one or more locomotives are available in one or more inbound train consists destined for the rail yard includes querying the train data management system 248 to determine whether any of the one or more locomotives 128 in one or more inbound train consists destined for the rail yard is available for inclusion in the railway car and locomotive makeup 270. Alternatively, determining whether one or more locomotives are available in the one or more inbound train consists destined for the railyard includes querying each of the one or more locomotives 128 in the one or more inbound train consists to determine whether any of the one or more locomotives in the one or more inbound train consists is available for inclusion in the railway car locomotive map makeup 270.

At operation 412, the rail yard management system 208 queries the energy management system 216 and the locomotive health management system 218 to determine an energy management profile and a locomotive health management profile for the railway car and locomotive makeup 270 of the train consist 124. According to examples, the energy management system determines the energy management profile by receiving energy management information for the one or more locomotives 120, 128 available for inclusion in the train consist. The locomotive health management system determines the locomotive health management profile based on locomotive health information received for each of the one or more locomotives included in the railway car and locomotive makeup 270.

Receiving energy management information for the one or more locomotives available for inclusion in the train consist includes receiving locomotive power capacity for each of the one or more locomotives available for inclusion in the train consist. According to examples, prior to determining the energy management profile for the railway car and locomotive makeup, the energy management system may receive route information for the train consist between a rail yard 110 at which the train consist 124 will be assembled and a destination for the train consist. Determining the energy management profile for the railway car locomotive makeup may include determining a total power capacity from the one or more locomotives required for moving the train consist along the route, including along terrain associated with the route. Similarly, receiving locomotive health information for the one or more locomotives available for inclusion in the train consist includes receiving reliability information (e.g., maintenance and performance information) for each of the one or more locomotives available for inclusion in the train consist. Determining the locomotive health management profile for the train consist may include determining a profile for the railway car and locomotive makeup 270 based on locomotive health scores for the individual locomotives included in the train consist.

At operation 416, prior to assigning one or more of the available locomotives to the train consist 124 to the railway car and locomotive makeup 270, the rail yard management system 208 along with the energy management system 216 may determine a combined power capacity required for moving the train consist along the route, including terrain associated with the route. If the combined power capacity for the one or more locomotives assigned to the railway car locomotive makeup exceeds a combined power capacity required for moving the train consist along the route including terrain associated with the route, then the one or more locomotives assigned to the railway car and locomotive makeup 270 may be revised to include one or more other locomotives that have a combined locomotive power capacity that does not exceed a combined power capacity required for moving the train consist along the route. Revising one or more locomotives assigned to the railway car and locomotive makeup may include replacing one or more of the locomotives assigned to the railway car and locomotive makeup 270 to include one or more other locomotives that have a combined locomotive power capacity that does not exceed a combined power capacity required for moving the train consist along the planned route. Alternatively, revising one or more locomotives assigned to the railway car locomotive makeup may include replacing one or more of locomotives assigned to the railway car locomotive makeup with one or more locomotives having a lower power capacity. As described herein, if the locomotives included in the train consist are revised to meet energy management requirements, the locomotives included in the train consist may be further revised to also meet locomotive health management requirements.

At operation 420, the train consist may be assembled according to the railway car and locomotive makeup 270 based at least in part on the determined energy management profile where the assembled train consist 124 is optimized for moving the train consist along the planned route and energy efficient manner.

FIG. 5 is a block diagram illustrating physical components of an example computing device with which examples of the present disclosure may be practiced. The computing device 500 may include at least one processing unit 502 and the system memory 504. The system memory 504 may comprise, but is not limited to, volatile (e.g., random access memory (RAM)), non-volatile (e.g., read only memory (ROM)), flash memory, or any combination thereof. System memory 504 may include an operating system 506, one or more program instruction 508, and may include sufficient computer-executable instructions for operating the train consist optimization system 204, the yard management system 208, the energy management system 216, the locomotive health management system 218, the train data management system computing systems 252, the onboard data and energy management system 260 and the railcar onboard data system 262, which when executed, perform functionalities as described herein. Operating system 506, for example, may be suitable for controlling the operation of the computing device 500. Furthermore, examples may be practiced in conjunction with a graphics library, other operating systems, or other application programs and is not limited to any application or system. This basic configuration is illustrated by those components within a dashed line 510. The computing device 500 may also include one or more input device(s) 512 (e.g., keyboard, mouse, pen, touch input device, etc.) and one or more output device(s) 514 (e.g., display, speakers, printers, etc.).

The computing device 500 may also include additional data storage devices (removable or non-removable) such as, for example, magnetic discs, optical discs, or tape. Such additional storage is illustrated by removable storage 516 and a nonremovable storage 518. The computing device 500 may also contain a communication connection 520 that may allow the computing device 500 to communicate with other computing devices 522, such as over a network in a distributed computing environment, for example, an intranet or the Internet. The communication connection 520 is an example of a communication medium, via which computer-readable transmission media (i.e., signals) may be propagated.

Program modules may include routines, programs, components, data structures, and other structures that may perform tasks or that may implement particular abstract data types. Moreover, examples may be practiced with other computer system configurations, including hand-held devices, multiprocessor systems, microprocessor-based or programmable user electronics, minicomputers, mainframe computers, and the like. Examples may also be practiced in distributed computing environments where tasks are performed by remote computing and processing devices that are linked through a communications network. In a distributed computing environment, programming modules may be located in both local and remote memory storage devices. Furthermore, examples may be practiced in an electrical circuit comprising discrete electronic elements, packaged or integrated electronic chips containing logic gates, a circuit using a microprocessor, or on a single chip containing electronic elements or microprocessors (e.g., a system-on-a-chip (SOC)). Examples may also be practiced using other technologies capable of performing logical operations such as, for example, AND, OR, and NOT, including but not limited to mechanical, optical, fluidic, and quantum technologies. In addition, examples may be practiced within a general-purpose computer or in other circuits or systems.

Examples may be implemented as a computer process (method), a computing system, or as an article of manufacture, such as a computer program product or computer-readable storage medium. The computer program product may be a computer storage medium readable by a computer system and encoding a computer program with instructions for executing a computer process. Accordingly, hardware or software (including firmware, resident software, microcode, etc.) may provide examples discussed herein. Examples may take the form of a computer program product on a computer-usable or computer-readable storage medium having computer-usable or computer-readable program code embodied in the medium for use by, or in connection with, an instruction execution system.

Examples of the present disclosure may be implemented via local and remote computing and data storage systems. Such memory storage and processing units may be implemented in a computing device. Any suitable combination of hardware, software, or firmware may be used to implement the memory storage and processing unit. For example, the memory storage and processing unit may be implemented within the computing device 500 or any other computing devices 522, in combination with the computing device 500, where functionality may be brought together over a network in a distributed computing environment, for example, an intranet or the Internet to perform the functions described herein. Systems, devices, and processors described herein are provided as examples; however, other systems, devices, and processors may comprise the memory storage and processing unit, consistent with the described disclosure.

Reference is made herein to the examples illustrated in the drawings, and specific language is used herein to describe the same. It will nevertheless be understood that no limitation of the scope of the technology is thereby intended. Alterations and further modifications of the features illustrated herein, and additional applications of the examples as illustrated herein, which would occur to one skilled in the relevant art and having possession of this disclosure, are to be considered within the scope of the description.

Furthermore, the described features, structures, or characteristics may be combined in any suitable manner in one or more examples. In the preceding description, numerous specific details have been provided, such as examples of various configurations to provide a thorough understanding of examples of the described technology. One skilled in the relevant art will recognize, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features, it is to be understood that the subject matter defined in the appended claims is not necessarily limited to the specific features described. Rather, the specific features are disclosed as illustrative forms of implementing the claims.

INDUSTRIAL APPLICABILITY

The present disclosure provides methods and systems for assembly of a train consist made up of a number of railway cars and locomotives. The railway cars and locomotives are assembled at a rail yard from one or more railway cars currently available in the rail yard and from one or more railway cars and locomotives that are inbound to the rail yard from one or more inbound train consists. To determine which and how many railway cars and locomotives are needed for assembly of the train consist, a rail yard management system determines a need for a train consist made up of a desired number of railway cars that will carry loads of cargo from the rail yard to a desired (and scheduled) destination along a prescribed route. Based on the weight and length of the combined railway cars and based on route and scheduling requirements, the rail yard management system determines a need for one or more locomotives to pull or push the railway cars along the route with consideration to route terrain, planned or anticipated stops, slowdown areas, and the like. Locomotives for the train consist, as well as positions of locomotives in the train consist are selected and positioned based on energy management attributes of the locomotives obtained from a centralized energy management system or obtained from energy management systems on board the locomotives. Locomotives for the train consist are also selected based on locomotive health attributes of the locomotives obtained from a locomotive health management system.

While traditional train consist assemblies select and employ a number of locomotives necessary for moving a combination of railway cars along a desired route according to a desired schedule, the methods and systems of the present disclosure select and position locomotives for a combination of railway cars based on energy needed for moving the combination of railway cars but also based on optimizing the selection and positioning of the locomotives so that the combination of railway cars are moved in an energy-efficient manner. That is, according to the methods and systems described herein, locomotives are selected and positioned so that the resulting train consist is not overpowered and consequently wasteful of available energy and resources. An energy management profile may be developed for an initially planned one or more locomotives to be used for the train consist. If the energy management profile indicates excessive amounts of energy (e.g., excessive available horsepower) will be used, the initially planned one or more locomotives may be dynamically and iteratively revised until a final set of one or more locomotives are assembled that will move the train consist as desired without wasting fuel, electricity and wear/tear for/on utilized locomotives that will result in failing to utilize locomotives in an energy-efficient manner.

In addition to selecting locomotives based on energy management considerations of individual and combinations of locomotives, locomotives may be placed within the combination of railway cars based on coupling forces between railway cars. Placement of locomotives based on coupling forces reduces wear and tear on coupling joints but also improves energy efficiency of the resulting train consist where simply pulling the entire train consist from a forward end or pushing the entire train consist from a rear end will require more energy than will be needed by interspersing locomotives at various locations in the combined train consist.

In addition to selecting locomotives based on energy management considerations, locomotives are also selected so that the locomotive health attributes of the train consist meet requirements of railway carriers. That is, given the conditions of routes to a train consist destination, railway carriers may require a prescribed level of locomotive reliability and health associated with locomotives assigned to a given train consist.

While aspects of the present disclosure have been particularly shown and described with reference to the embodiments above, it will be understood by those skilled in the art that various additional embodiments may be contemplated by the modification of the disclosed machines, systems, and methods without departing from the spirit and scope of what is disclosed. Such embodiments should be understood to fall within the scope of the present disclosure as determined based upon the claims and any equivalents thereof.

The invention claimed is:

1. A method of building a train consist, comprising:

receiving a request for a train consist;

determining a railway car makeup including one or more railway cars, and a locomotive makeup including one or more locomotives;

determining a total power availability for the one or more locomotives included in the locomotive makeup;

in response to a determination that the total power availability exceeds a total power availability required for moving the train consist along a route, revising the locomotive makeup to a revised locomotive makeup having a revised total power availability less than or equal to a prescribed energy profile range for the train consist; and causing, by a rail yard management system, assembly of the train consist according to the railway car makeup and the revised locomotive makeup.

2. The method of claim 1, wherein determining the total power availability includes:

receiving energy management information for the one or more locomotives included in the locomotive makeup; and determining the total power availability based on the energy management information received for the one or more locomotives included in the and locomotive makeup.

3. The method of claim 2, wherein receiving energy management information for the one or more locomotives included in the locomotive makeup includes receiving a locomotive power availability for each of the one or more locomotives included in the locomotive makeup.

4. The method of claim 1, wherein assembly of the train consist according to the railway car makeup and the revised locomotive makeup includes moving the one or more railway cars included in the railway car makeup and the one or more locomotives included in the revised locomotive makeup into a train consist build area.

5. The method of claim 1, wherein revising the locomotive makeup to the revised locomotive makeup includes iteratively revising the locomotive makeup until the revised total power availability is less than or equal to the prescribed energy profile range.

6. The method of claim 1, further comprising:

prior to determining the railway car makeup and the locomotive makeup, determining whether one or more railway cars are available at a rail yard for inclusion in the railway car makeup and the locomotive makeup; and if one or more railway cars are not available at the rail yard, determining whether one or more railway cars are available in one or more inbound train consists destined for the rail yard.

7. The method of claim 1, prior to determining the railway car makeup and the locomotive makeup of the train consist; further comprising:

determining whether one or more locomotives are available at a rail yard for inclusion in the railway car makeup and the locomotive makeup; and if one or more locomotives are not available at the rail yard, determining whether one or more locomotives are available in one or more inbound train consists destined for the rail yard.

8. The method of claim 7, wherein determining whether one or more locomotives are available in one or more inbound train consists destined for the rail yard includes querying a train data management system to determine whether any of the one or more locomotives in the one or more inbound train consists destined for the rail yard is available for inclusion in the railway car makeup and the locomotive makeup.

9. The method of claim 7, wherein determining whether one or more locomotives are available in one or more inbound train consists destined for the rail yard includes querying each of the one or more locomotives in the one or more inbound train consists to determine whether any of the one or more locomotives in the one or more inbound train consists destined for the rail yard is available for inclusion in the railway car makeup and the locomotive makeup.

10. The method of claim 2, further comprising:

prior to determining the total power availability for the one or more locomotives included in the locomotive makeup:

receiving route information for the train consist between a rail yard at which the train consist is assembled and a destination for the train consist;

wherein receiving energy management information for one or more locomotives available for inclusion in the train consist includes receiving locomotive power availability for each of the one or more locomotives; and wherein determining the total power availability for the one or more locomotives included in the locomotive makeup includes determining a total power availability for the one or more locomotives required for moving the train consist along the route.

11. The method of claim 10, wherein receiving route information for the train consist includes receiving terrain information for the route, and determining the total power availability for the one or more locomotives included in locomotive makeup includes determining a total power availability from the one or more locomotives required for moving the train consist along the route based at least in part on the terrain information for the route.

12. The method of claim 1, further comprising:

determining a locomotive health management profile for the railway car makeup and the locomotive makeup of the train consist; and assembling the train consist based at least in part on the locomotive health management profile.

13. The method of claim 12, wherein determining the locomotive health management profile for the railway car makeup and the locomotive makeup of the train consist includes:

receiving a locomotive health score for each of one or more locomotives included in the railway car makeup and the locomotive makeup of the train consist; and receiving one or more operating parameters for the one or more locomotives included in the railway car makeup and the locomotive makeup of the train consist, the one or more operating parameters defining an acceptable health score for operation of the one or more locomotives included in the railway car makeup and the locomotive makeup of the train consist along a railway route.

14. A system for building a train consist, comprising:

a rail yard management system operative to receive a request for a train consist including one or more railway cars and one or more locomotives;

to determine availability of one or more railway cars for inclusion in the train consist;

to determine availability of one or more locomotives for inclusion in the train consist;

to determine a railway car makeup and a locomotive makeup of the train consist based on availability of one or more railway cars and locomotives for inclusion in the train consist;

an energy management system operative to determine a total power availability for the one or more locomotives included in the locomotive makeup;

to revise the locomotive makeup until a revised locomotive makeup has a total power availability less than or equal to a prescribed energy profile range for the train consist in response to a determination that the total power availability exceeds a total power availability required for moving the train consist along a route; and the rail yard management system being further operative to assemble the train consist according to the railway car makeup and the revised locomotive makeup.

15. The system of claim 14, wherein the energy management system is further operative to receive energy management information for the one or more locomotives available for inclusion in the train consist; and to determine the total power availability based on the energy management information received for each of one or more locomotives included in the railway car makeup and the locomotive makeup.

16. The system of claim 14, wherein the energy management system is further operative to receive a locomotive power availability for each of the one or more locomotives available for inclusion in the train consist;

to receive route information including terrain information for a route for the train consist between a rail yard at which the train consist is assembled and a destination for the train consist; and to determine the total power availability for the one or more locomotives included in the locomotive makeup based at least in part on a total power availability for the one or more locomotives required for moving the train consist along the route and over route terrain.

17. The system of claim 16, the rail yard management system being further operative to assign one or more locomotives available for inclusion in the train consist to the railway car makeup and the locomotive makeup; and to query the energy management system to determine if a combined power availability of the one or more locomotives assigned to the railway car makeup and the locomotive makeup exceeds a combined power availability required for moving the train consist along the route and over route terrain.

18. The system of claim 14, wherein the rail yard management system being further operative to determine whether one or more railway cars are available at a rail yard for inclusion in the railway car makeup and the locomotive makeup;

if one or more railway cars are not available at the rail yard, to determine whether one or more railway cars are available in one or more inbound train consists destined for the rail yard;

to determine whether one or more locomotives are available at a rail yard for inclusion in the railway car makeup and the locomotive makeup; and if one or more locomotives are not available at the rail yard, to determine whether one or more locomotives are available in one or more inbound train consists destined for the rail yard.

19. A system for building a train consist, comprising:

a rail yard management system operative to determine one or more railway cars and one or more locomotives available in a rail yard that may be used in the train consist;

to predict one or more railway cars and locomotives inbound to the rail yard that will be available for use in the train consist after arrival at the rail yard;

to generate an initial train consist build based on one or more railway cars and one or more locomotives available for use in the train consist;

an energy management system operative to determine a total power availability for the one or more locomotives available for use in the train consist;

to revise the initial train consist until a revised train consist has a total power availability less than or equal to a prescribed energy profile range required for moving the train consist along a route;

a locomotive health management system operative to generate a locomotive health management profile for the initial train consist build based at least in part on inclusion of locomotive health management information associated with one or more locomotives included in the initial train consist build; and the rail yard management system being further operative to determine whether the revised train consist is optimized for energy efficiency based at least in part on whether energy management information associated with one or more locomotives included in the initial train consist build indicates energy associated with the one or more locomotives exceeds energy required for moving a train consist built according to the initial train consist build along the route for the train consist;

to determine whether the revised train consist is optimized for locomotive health management based at least in part on whether locomotive health management information associated with one or more locomotives included in the initial train consist build indicates a locomotive health score for each of the one or more locomotives included in the initial train consist meets one or more acceptable locomotive health operating parameters for the route of the train consist; and to move one or more railway cars and one or more locomotives included in a revised train consist into a train consist build area and to assemble the revised train consist.

20. The system for building a train consist of claim 19, the rail yard management system being further operative to query the energy management system to determine if the total power availability of the one or more locomotives exceeds a total power availability required for moving the initial train consist along the route.

* * * * *